US007086923B2

(12) United States Patent
Karabees

(10) Patent No.: US 7,086,923 B2
(45) Date of Patent: Aug. 8, 2006

(54) TRANSFORMABLE TOY FURNITURE AND ROOM SYSTEM

(75) Inventor: Martin W. Karabees, Manhattan Beach, CA (US)

(73) Assignee: Build-A-Bear Retail Management, Inc., St. Louis, MO (US)

( * ) Notice: Subject to any disclaimer, the term of this patent is extended or adjusted under 35 U.S.C. 154(b) by 28 days.

(21) Appl. No.: 10/708,630

(22) Filed: Mar. 16, 2004

(65) Prior Publication Data

US 2005/0208866 A1 Sep. 22, 2005

(51) Int. Cl.
*A63H 3/52* (2006.01)

(52) U.S. Cl. ..... 446/479; 446/110

(58) Field of Classification Search ..... 446/479, 446/482, 110, 120–127; 312/204, 702; 108/90; D21/499; D19/59
See application file for complete search history.

(56) References Cited

U.S. PATENT DOCUMENTS 1,379,648 A * 5/1921 Niebel ..... 446/69
1,453,241 A * 4/1923 Duffield ..... 446/114
2,013,771 A * 9/1935 Tompkins ..... 446/121
3,751,848 A * 8/1973 Ahlstrand ..... 446/110
4,077,517 A * 3/1978 Hilemn ..... 206/577
4,212,130 A * 7/1980 Walker ..... 446/111
4,624,649 A * 11/1986 Blocker ..... 446/482
5,069,647 A * 12/1991 Zuviria ..... 446/127
5,509,720 A * 4/1996 Croom ..... 297/440.14
5,554,062 A * 9/1996 Goldsen ..... 446/124
5,735,723 A * 4/1998 von Oppen ..... 446/85
5,782,667 A * 7/1998 Luby ..... 446/69
5,910,037 A * 6/1999 Bach et al. ..... 446/108
6,209,973 B1 * 4/2001 Steinberg ..... 312/7.2

* cited by examiner

*Primary Examiner*—Kien Nguyen
(74) *Attorney, Agent, or Firm*—Blackwell Sanders Peper Martin LLP

(57) ABSTRACT

A system and method for simulating a wide variety of different toy furniture items including a plurality of three-dimensional predetermined shaped members wherein at least some of the predetermined shaped members are adaptable to be positioned and repositioned adjacent to other shaped members in a plurality of different configurations to simulate a plurality of different furniture items. The present system and method further includes providing a plurality of slipcovers having indicia associated therewith which are shaped and dimensioned respectively to be positioned over at least one of the plurality of shaped members to simulate the particular furniture item or other home/business furnishing depicted on the slipcover, and providing at least one wall board having indicia associated therewith for simulating a particular room setting, the wall board being used in conjunction with the system components to simulate different room settings.

53 Claims, 8 Drawing Sheets

TRANSFORMABLE TOY FURNITURE AND ROOM SYSTEM

BACKGROUND OF INVENTION

The present invention relates to toy furniture and the creation of simulated doll house type rooms for children's play and, more particularly, to a system, method and kit which utilizes a combination of predetermined structural shapes which can be arranged and transformed into a multitude of different types of furniture along with wallboards and other accessories to create a simulated room for play with toy dolls and the like. The present invention also includes a plurality of slipcovers adaptable for placement over at least some of the predetermined structural shapes, the slipcovers including indicia thereon to simulate specific furniture items as well as appliances and other home/business furnishings.

Doll houses, toy houses, toy furniture and other furnishings for designing a simulated doll house type room such as a kitchen, bedroom, parlor, living room and so forth are well known in the art. It is known to provide toy houses having internal partitions or walls dividing the interior of the house into a plurality of miniature rooms having floors, ceilings and upright walls. It is also known to provide wall and floor boards having various patterns and indicia associated therewith to simulate the walls and floor coverings of a particular room such as windows, fixtures and other features associated with a particular room including accessories that can be cooperatively attached to the wallboards, various furnishings such as simulated windows, mantels, pictures, mirrors and various types of other fixtures including simulated furniture. It is also well known to provide miniature toy furniture such as chairs, couches, beds, stoves and so forth along with miniature toy furnishings such as rugs, pictures and the like wherein a child can place these items in a doll house or in a simulated room arrangement in positions that simulate a realistic home/business setting.

Almost all of the toy furniture for use in doll type house and simulated room settings are specific furniture pieces. In other words, such toy furniture has a single purpose, that is, it represents a specific piece of furniture such as a chair, table, bed, sofa and so forth. As a result, a multitude of different types of specific furniture items must be purchased in order to furnish specific simulated room settings. This can be quite expensive. Although dual-purpose toy furniture assemblies are known in the art, such assemblies are extremely limited in function and application. For example, U.S. Pat. No. 4,624,649 discloses a toy furniture device adapted from a couch arrangement to a fold-down bed arrangement. The device includes a box-shaped main frame member within which a bed member is pivotally supported, the bed member being pivotally movable between a stored position within the main frame member to define a couch configuration and a folded-down position wherein it extends substantially perpendicular from the main frame member to define the bed arrangement. Although this particular piece of toy furniture is convertible, it's dual purpose is limited to a couch and bed arrangement and it is not transformable into other desired furniture configurations. As such, the known toy furniture assemblies are not designed to be transformable into a plurality of different, separate, distinct furniture items. As a result, there is generally no utility to single or dual-purpose toy furniture assemblies beyond the singular or dual purpose for which they are designed. None of the known toy furniture constructions provides a child with a compact and easy manipulative arrangement of components which permits simple and yet entertaining conversion between desired furniture configurations.

Thus, there is a need for multi-functional toy furniture which can be used for numerous applications and can be placed in a variety of different room settings. It is also desirable to provide toy furniture which can be handled with ease by even young children, and which affords sufficient novelty so as to entertain children even after many hours of play.

SUMMARY OF INVENTION

In one aspect of the present invention, a plurality of predetermined structural/geometric shapes in the form of modular members or pieces are provided for use in constructing a wide variety of different furniture items. The plurality of predetermined shapes may include three-dimensional pieces in the form of rectangles, squares, circles, triangles, L-shaped pieces and so forth. These predetermined shapes may be provided in a multitude of different sizes such that one or more shaped pieces may be utilized in various combinations to simulate a plurality of different furniture items. For example, a plurality of the present predetermined shaped pieces may be positioned and arranged in side-by-side relationship adjacent one another and/or positioned in a stacked arrangement to simulate a bed, a sofa or couch, a coffee table, a chair and ottoman, an occasional table, a sectional and so forth. The present predetermined shaped members are not necessarily physically attached to each other in any particular configuration, but instead, are merely positioned in adjacent abutting relationship to each other in order to simulate a particular furniture item. This facilitates easy transformation from one furniture item to another furniture item and, importantly, stimulates a child's imagination and allows a child to selectively manipulate the plurality of shaped pieces to achieve any imaginative arrangement during play. The present plurality of predetermined structural shapes can therefore be characterized as a transformable furniture system that includes a plurality of components that are positioned and repositioned in a multitude of different configurations so as to conform to a wide variety of different individual pieces of furniture.

In another aspect of the present invention, a plurality of slipcovers having indicia thereon representative of different furniture items, fixtures, appliances, and other home/business furnishings are provided for use with the predetermined structural shapes to further simulate different items of furniture including other furnishings and fixtures such as a TV set, a radio, and so forth. The present slipcovers are shaped and dimensioned so as to be removably positioned over at least some of the predetermined structural shapes to transform that particular predetermined structural shape into the furniture item or other home/business furnishing representative of the indicia associated with that particular slipcover. Here again, the present invention can also be characterized as a transformable furniture system that includes a plurality of slipcovers having furniture or other indicia associated therewith that are cooperatively removably receivable over one or more predetermined shaped pieces so as to again simulate individual pieces of furniture or other home furnishings.

In another aspect of the present invention, one or more wall boards are provided to simulate at least some of the walls associated with a particular room in a house. Each wall panel may include a single panel which is foldable or bendable at one or more locations therealong to simulate a plurality of walls associated with a particular room, or a plurality of individual wall panels may be provided, each wall panel being cooperatively engageable with an adjacent wall panel. The present wall panels may likewise include indicia thereon representative of a particular room in a house or business such as a sink, towel rack, medicine cabinet, and other accessories typically associated with a bathroom; a fireplace, wood paneling, pictures, drapes and other accessories including furniture typically associated with a living room or family room, and so forth. Any room in any house or business can be simulated and portrayed. The present wall boards are used in conjunction with the plurality of predetermined structural shapes and plurality of slipcovers to simulate a particular room setting, the present predetermined shaped pieces and slipcovers being positioned and oriented so as to simulate specific furniture items associated with a particular room setting. Other accessories in the form of various window treatments such as drapes, blinds and curtains, shower curtains for a bathroom setting, wall hangings and other room accent pieces can likewise be provided for attachment to the present wall boards, or placement within a particular simulated room setting to further stimulate and enhance the play of a child.

All of the various components of the present system can be packaged and provided in kit form based upon furniture and furnishings associated with a particular room; based upon a particular category of furniture items; based upon any combination of furniture items and room furnishings; based upon individual items; or the entire system can be provided in a single package.

Other aspects and advantages of the present system will become apparent from the following detailed description taken in conjunction with the accompanying drawings.

DETAILED DESCRIPTION

Figure 1:
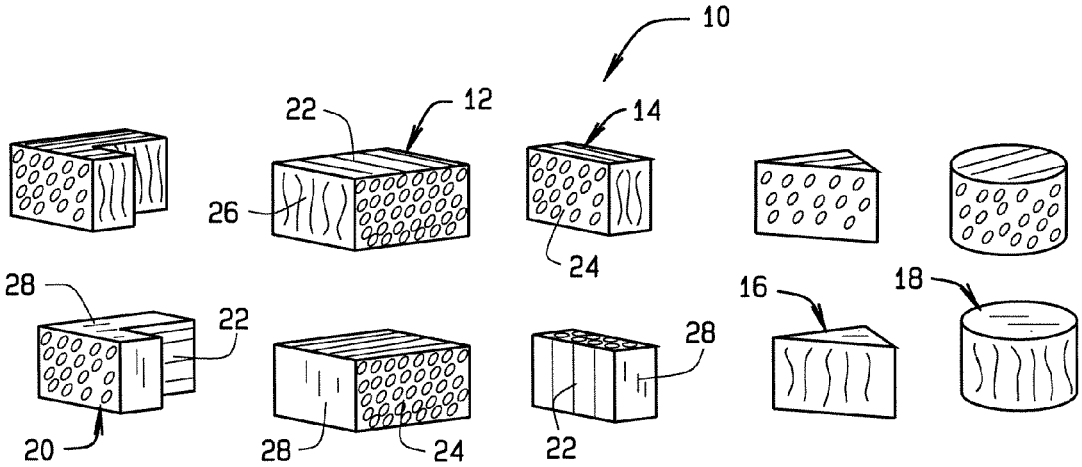
FIG. 1 is a perspective view of some of the present predetermined geometrically shaped system components constructed in accordance with the teachings of the present invention.

Referring to the drawings more particularly by reference numbers wherein like numerals refer to like parts, member 10 in FIG. 1 identifies one system of the present invention which includes a plurality of three-dimensional predetermined structural shapes, pieces or members which can be positioned and repositioned adjacent to each other in a plurality of configurations to simulate different household and business type furniture items. In the particular embodiment illustrated in FIG. 1, the predetermined structural pieces of the present invention include a pair of substantially square shaped members 12, a pair of substantially rectangularly shaped members 14, a pair of substantially triangularly shaped members 16, a pair of circular or cylindrical shaped members 18, and a pair of L-shaped members 20. Although a set number of predetermined structurally shaped members 10 are illustrated in FIG. 1, it is recognized and anticipated that any plurality of such members 12, 14, 16, 18 and 20 may be provided, and it is recognized and anticipated that a wide variety of other geometrically shaped members may also be provided as part of the present system. As a result, the disclosure and description of the present system 10 is not to be taken in a limiting sense but a representative sample of geometrically shaped pieces such as members 12, 14, 16, 18 and 20 are merely presented herein for the purpose of describing the general principles and operation of the present transformable toy furniture system. Any plurality of differently shaped pieces may be provided in any system or kit as will be hereinafter further explained.

The present system components, such as the members 12, 14, 16, 18 and 20, are preferably sized so as to be compatible with the particular simulated room setting and/or with the particular toy dolls, animals or other toy characters for which the present system is designed. Although the size of each individual component may vary, the present system is specifically designed to simulate toy furniture and, as such, the term "toy furniture" as used herein is intended to refer to and/or define furniture such as the type commonly used by children when playing with doll houses, toy dolls, animals or other similar toys.

The present predetermined structural components such as the members 12, 14, 16, 18 and 20 can be made of any suitable materials for play by children but, preferably, are made of a soft durable material such as foam, rubber, and other pliable and/or resilient materials. For example, each component member may include an exterior fabric material which is stuffed with a suitable stuffing material such as cotton or some other soft pliable material. In addition, the exterior surfaces of each component member may include a decorative design or indicia so as to represent a particular upholstery pattern such as the striped pattern 22, the polka dot pattern 24, a wavy pattern 26, and a solid pattern 28 illustrated on some of the respective side surfaces of the various component members illustrated in FIG. 1. In this regard, each component member may include one particular pattern on all of its various exterior surfaces or, as illustrated in FIG. 1, each component may include a different pattern on each respective exterior surface, or a similar pattern may be associated with some but not all of the exterior surfaces associated with a particular component. Also, importantly, similar patterns may be associated with predetermined exterior surfaces of the various system components such that when the components are positioned and combined to achieve a particular furniture item as will be hereinafter explained, the respective exterior surfaces of each such component used to simulate a particular furniture piece will present the same pattern for viewing based upon a specific arrangement of system components. It is recognized and anticipated that other patterns and indicia may be used on the various exterior surfaces of the present system components such as the members 12–20 to achieve any desired effect.

Figure 2:
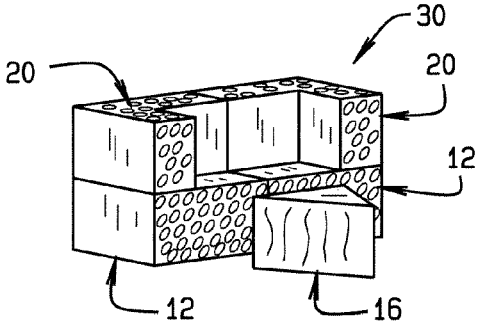
FIG. 2 is a perspective view of a particular toy furniture item such as a small couch or love seat and associated table formed by maneuvering and positioning some of the present system components illustrated in FIG. 1.

The system components of the present invention such as the predetermined structural members 12, 14, 16, 18 and 20 illustrated in FIG. 1 can be easily maneuvered and positioned in side-by-side adjacent relationship and in various stacked relationships so as to achieve a wide variety of different furniture items. For example, as best illustrated in FIG. 2, the system components 12 and 20 can be easily maneuvered and positioned to simulate a small couch or love seat 30. A pair of system members 12 are positioned in side-by-side abutting relationship and a pair of system members 20 are positioned on top of members 12 as illustrated in FIG. 2 to represent a small couch or love seat. In addition, the triangular system component 16 can be positioned in front of the couch or love seat 30 to simulate a traditional coffee table or other occasional table. Importantly, none of the system components 12 and 20 are physically attached or otherwise secured to each other thereby facilitating a small child to use their imagination to selectively manipulate the present system components to assemble, disassemble and reassemble various system components to achieve a wide variety of different furniture items or alternative arrangements of the system components during play. On the other hand, it is also recognized and anticipated that some form of connection means such as strips of VELCRO® type fasteners can be strategically positioned at one or more locations on each of the system components such as the members 12, 14, 16, 18 and 20 so as to facilitate removable attachment of the various system components to one another in a wide variety of adjacent abutting relationships. When the couch or love seat 30 illustrated in FIG. 2 is no longer needed for play, it can be easily disassembled and some or all of the components 12 and 20 can be reused by themselves or in combination with other system components to simulate another particular furniture item.

Figure 3:
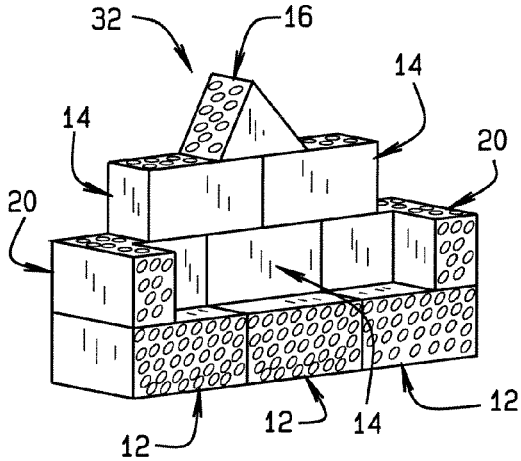
FIG. 3 is a perspective view illustrating another furniture item such as a traditional couch formed by maneuvering and positioning some of the present system components illustrated in FIG. 1.

FIG. 3 represents another particular furniture item constructed in accordance with the teachings of the present invention and use of a plurality of different system components. In FIG. 3 a traditional couch 32 is simulated through the positioning of system components 12, 14, 16 and 20 as illustrated in FIG. 1. More particularly, three substantially square system components 12 are positioned in side-by-side relationship to form the sitting surface of a traditional couch. L-shaped system component members 20 are positioned on top of the two outwardly positioned members 12 and a rectangular system component 14 is positioned therebetween so as to simulate the formation of the back resting portion and arm portions of a traditional couch. In addition, a pair of rectangular system component members 14 are positioned on top of members 20 and 14 as illustrated in FIG. 3 and a triangular component member 16 is further positioned on top of the pair of members 14 to simulate a decorative center arrangement associated with the back portion of couch 32. In this regard, it is recognized and anticipated that a wide variety of other system components and other geometrically shaped system components can be utilized to form the decorative center portion of couch 32. Also, the various exterior side portions associated with the various system component members can be strategically positioned and matched so as to produce a wide variety of different visually attractive patterns, either coordinated or uncoordinated, as desired. Still other arrangements of the various system components are recognized and anticipated to simulate a wide variety of different styles of couches and sectionals.

Figure 4:
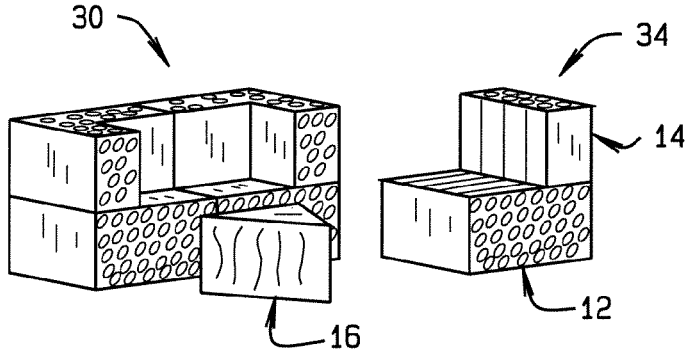
FIG. 4 is a perspective view illustrating a simulated room setting wherein a plurality of the present system components (FIG. 1) are manipulated and arranged so as to simulate a couch, a table and a chair or sectional piece.

FIG. 4 illustrates a simulated toy room setting wherein a plurality of the present system components are manipulated and arranged so as to simulate a couch 30 as previously explained with respect to the arrangement illustrated in FIG. 2, a coffee table or centerpiece formed using system component 16, and a chair or sectional piece 34 formed by using system components 12 and 14. Here again, any plurality of the present system components such as those illustrated in FIG. 1, as well as other geometrical shapes not illustrated, can be utilized in a wide variety of different combinations to achieve a multitude of different furniture items as well as a multitude of different room settings.

Figure 5:
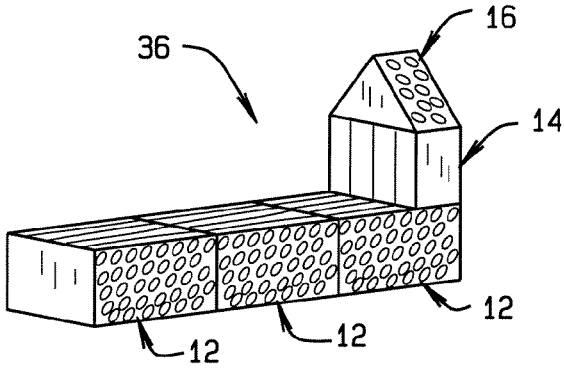
FIG. 5 is a perspective view illustrating a toy bed formed from a plurality of the system components illustrated in FIG. 1.

FIG. 5 represents a simulated toy bed 36 constructed from a plurality of system components 12, 14 and 16. More particularly, three system components 12 are positioned in side-by-side relationship as illustrated in FIG. 5 to simulate the basic bed surface and system components 14 and 16 are positioned in a stacked arrangement one on top of the other on top of one of the shaped members 12 adjacent one end portion thereof to represent the headboard associated with the simulated bed 36. Here again, any plurality and any arrangement of the various system components such as the components 14, 16, 18 and 20 can be utilized to represent a headboard associated with any particular simulated bedding surface. It is also anticipated that the bed surface itself can be formed using other system components such as a combination of members 12, 14, 16 and even 18. Still other variations of the present system components to achieve and simulate a bed or other bedding surface are recognized and anticipated.

Figure 6:
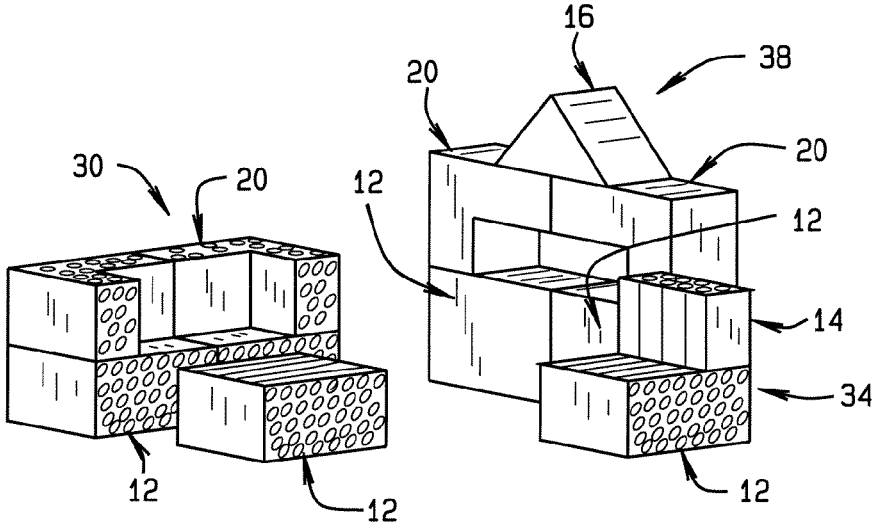
FIG. 6 is a perspective view illustrating another typical room setting wherein a plurality of the present system components (FIG. 1) are used to simulate a small couch or love seat, a chair or sectional piece, a table, and a wall unit.

FIG. 6 illustrates another typical toy room setting utilizing a plurality of the present system components such as the predetermined structural members 12, 14, 16, 18 and 20. In the particular room setting of FIG. 6, the love seat 30 of FIG. 2 and the chair or sectional piece 34 of Fig. are utilized in conjunction with a coffee table or occasional table formed from the use of a single component member 12. In addition, the room setting illustrated in FIG. 6 also includes a wall unit 38 formed by positioning two system component members 12 in side-by-side relationship and placing thereupon a pair of L-shaped system members 20 as illustrated. An additional system member 16 is positioned on top of the members 20 at approximately the center thereof to complete the wall unit 38. The wall unit 38 could simulate a cabinet or shelving type wall structure, an audio/visual entertainment center, or some other wall unit. The room setting of FIG. 6 is for illustrative purposes only and is disclosed to illustrate how a plurality of the individual system component members such as the members 12, 14, 16, 18 and 20 can be positioned to simulate a wide variety of different furniture pieces and home furnishings associated with a particular room setting. When the particular furniture items illustrated in FIG. 6 are no longer needed, all such furniture items can be easily disassembled and some or all of the individual system components can be reused in an entirely different arrangement to simulate different pieces of furniture and different room settings.

Figure 7:
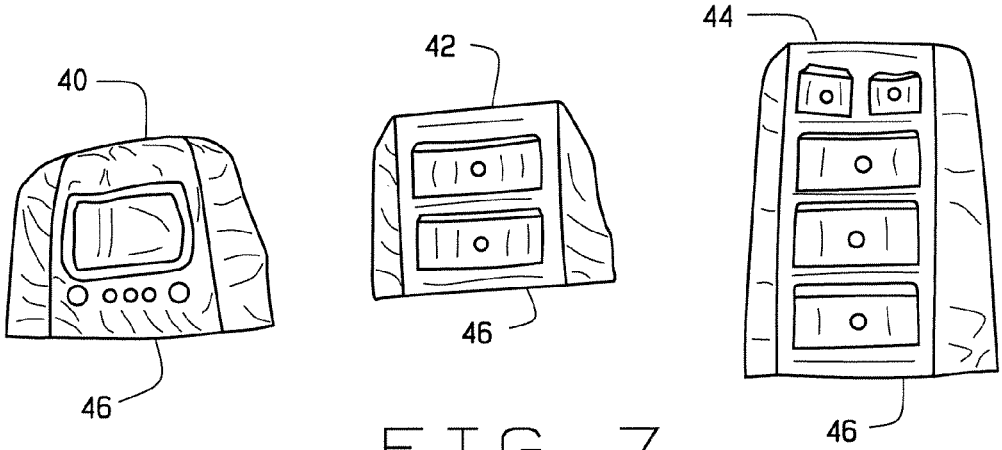
FIG. 7 is a perspective view illustrating a plurality of slipcovers constructed in accordance with the teachings of another aspect of the present invention.

In another aspect of the present invention, a plurality of slipcovers such as the slipcovers 40, 42 and 44 illustrated in FIG. 7 are provided for use with the system components such as members 12, 14, 16, 18 and 20 to further simulate different items of furniture including other home/business furnishings and related fixtures. Importantly, the present slipcovers include indicia thereon representative of different furniture items, fixtures, appliances and other home/business furnishings such as the indicia illustrated in FIG. 7 with respect to slipcovers 40, 42 and 44. Slipcover 40 is specifically designed to represent and/or simulate a TV set; slipcover 42 is specifically designed to represent and/or simulate a small dresser or chest of drawers; and slipcover 44 is specifically designed to represent and/or simulate a large dresser or chest of drawers. The present slipcovers are preferably made of a fabric material and are shaped and dimensioned similar to traditional slipcover type products so as to be removably positioned over some of the specific system components previously described to transform that particular system component into the furniture item or other home/business furnishing representative of the indicia associated with that particular slipcover.

Figure 8:
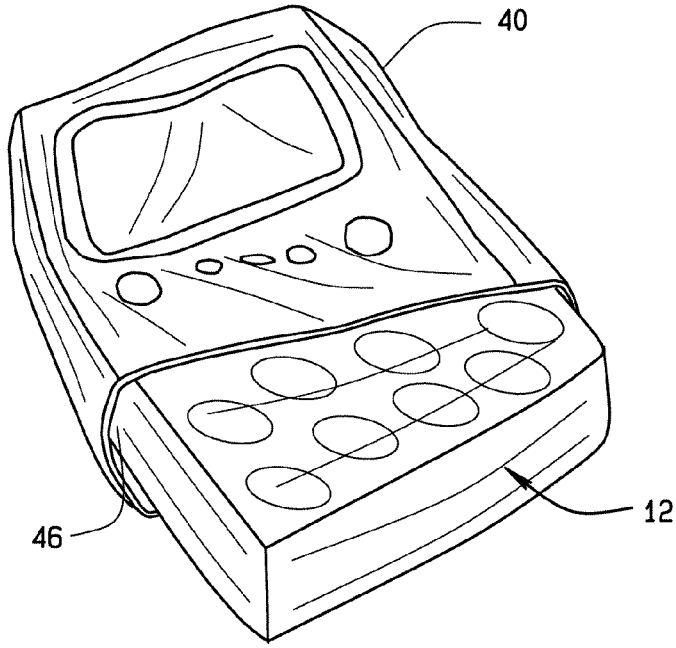
FIGS. 8 and 9 illustrate how one of the present slipcovers illustrated in FIG. 7 is positioned and maneuvered over one of the present system components illustrated in FIG. 1 to simulate a different furniture item such as a TV set.
Figure 9:
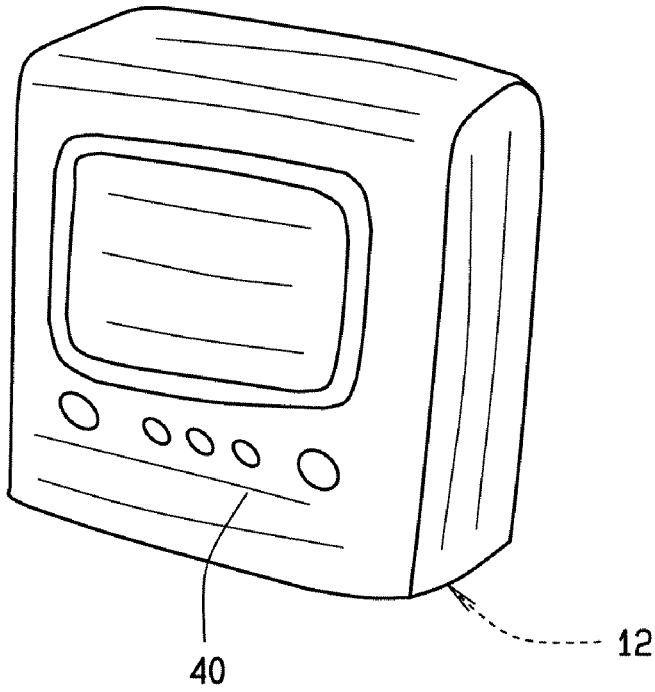

For example, each of the slipcovers 40, 42 and 44 include a hollow interior accessible from an open end portion associated with one end portion of the present slipcovers such as the open end portion 46 associated with each of the slipcovers 40, 42 and 44 illustrated in FIG. 7. As best illustrated in FIG. 8, slipcover 40, which includes indicia representative of a TV set, is specifically dimensioned for being positioned over system component 12. In this regard, system component 12 is insertably receivable within the hollow interior of slipcover 40 and when slipcover 40 is fully positioned over system component 12 as illustrated in FIG. 9, the system component 12 is transformed into a home furnishing item such as the TV set illustrated in FIG. 9. When the TV set simulated by slipcover 40 positioned over system component 12 is no longer needed for play, slipcover 40 can be easily removed from component 12 and component 12 can be reused by itself or in combination with other system components or other slipcovers as will be hereinafter explained to simulate another particular furniture item or home/business furnishing.

Figure 10:
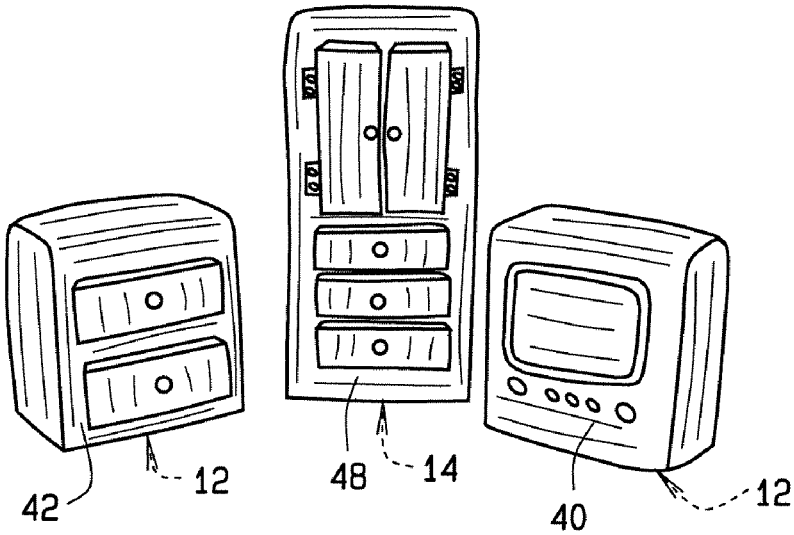
FIG. 10 illustrates a simulation of several different furniture items which are achieved by positioning different slipcovers constructed in accordance with the teachings of the present invention over different system components illustrated in FIG. 1.

FIG. 10 illustrates the simulation of several different furniture items constructed in accordance with the teachings of the present invention wherein slipcovers 40, 42 and 48 are utilized in conjunction with different system components to simulate a particular furniture item. Besides simulating a TV set through the use of slipcover 40 positioned over system component 12 as previously described with respect to FIGS. 8 and 9, FIG. 10 also illustrates the simulation of a small dresser or chest of drawers and an armoire or large cupboard with doors, shelves and drawers. The small dresser or chest of drawers is simulated through the use of slipcover 42 positioned over system component 12 as previously explained with respect to the use of slipcover 40 as illustrated in FIGS. 8 and 9. On the other hand, slipcover 48 has indicia thereon which represents and/or simulates an armoire which is shaped and dimensioned for being positioned over a rectangularly shaped system component such as system component 14. Slipcover 48 is positioned and maneuvered over system component 14 in a similar manner as previously described with respect to slipcover 40 illustrated in FIGS. 8 and 9. Also, it should be noted that slipcover 44 is substantially the same as slipcover 48 except that the indicia associated therewith represents and/or simulates a different furniture item. Its function and use is substantially similar to that described with respect to slipcover 48. Here again, once any one of the particular furniture items or other home/business furnishing item represented by slipcovers 40, 42, 44 and 48 are no longer needed for play, they can be easily removed and all of the system components including other slipcovers can be reused in any combination to simulate other furniture items and/or home/business furnishings.

It is also recognized that a wide variety of other indicia can be associated with the present slipcovers and that the present slipcovers can be shaped and dimensioned so as to be utilized with any of the geometrically shaped system components such as any one of the components 12, 14, 16, 18, 20 and still other differently shaped components not illustrated herein. Still further, it is also recognized and anticipated that the present slipcovers can be shaped and dimensioned so as to receive various system components from different directions or different orientations. For example, slipcovers 44 and 48 are specifically designed to be positioned over a similarly shaped rectangular system component such as component 14, when component 14 is positioned in an upward orientation and slipcovers 44 and 48 are moved over member 14 in a direction along its longitudinal axis. In contrast, other slipcovers can be designed for positioning over system component 14 when component 14 is positioned such that it's longitudinal axis lies substantially parallel to the supporting surface upon which it rests and such slipcovers are moved in a direction parallel to the transverse axis of component 14. Still other arrangements of slipcovers in combination with various system components are recognized and anticipated to simulate a wide variety of different furniture items and other home/business furnishings. This includes slipcovers specifically designed to insertably receive any geometrically shaped system component from one or more sides or orientations including the triangularly shaped components 16, the circular shaped components 18, and the L-shaped components 20 illustrated in FIG. 1.

Figure 11:
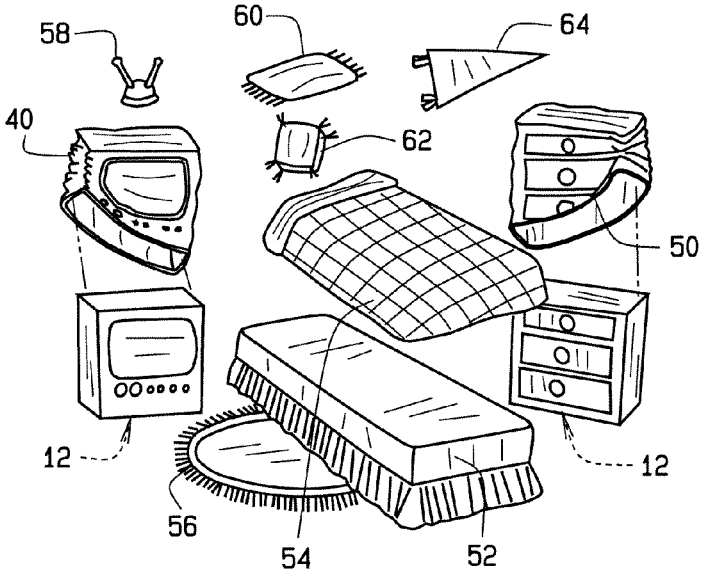
FIG. 11 illustrates a simulated room setting wherein all of the toy furniture items, namely, a conventional TV set, a 3-drawer dresser, and a bed, are achieved by utilizing a plurality of the present slipcovers in combination with a plurality of different system components.

FIG. 11 illustrates a simulated toy room setting wherein all of the simulated furniture items are constructed utilizing a plurality of the present slipcovers which are manipulated and arranged over a plurality of the present system components as will be hereinafter described. More particularly, as previously described with respect to FIGS. 7–10, slipcover 40 is used in conjunction with system component 12 to simulate a conventional TV set. Slipcover 50, which is somewhat similar to slipcover 42, is used in conjunction with system component 12 to simulate a dresser having 3 drawers instead of 2 drawers as simulated by slipcover 42. More importantly, slipcovers 52 and 54 are specifically designed for being positioned over a plurality of system components which are maneuvered and arranged to achieve a specific configuration. For example, slipcover 52 represents and/or simulates a finished sheet and bed skirt for positioning over a plurality of system components which are maneuvered to simulate a toy bed such as the bed 36 illustrated in FIG. 5. Slipcover 52 could be specifically designed to be positioned over a plurality of system components 12 positioned in side-by-side relationship as illustrated in FIG. 5 to simulate the basic bed surface, or slipcover 52 could be specifically designed to be positioned over a bedding surface formed by positioning system components 12 and 14 in side-by-side relationship to achieve a substantially flat bedding surface. Importantly, slipcover 52 as well as slipcover 54 are specifically shaped and dimensioned to overlay a plurality of system components as compared to slipcovers 40, 42, 44, 48 and 50 illustrated herein which are specifically designed for being positioned over a single system component. Like slipcover 52, slipcover 54 includes indicia representative of a bed cover, bedspread, or comforter which again is designed for being positioned over a plurality of system components which are manipulated and arranged into a specific configuration as previously explained. Here again, it is recognized and anticipated that any plurality of slipcovers can be shaped and dimensioned to cooperatively engage any plurality of system components such as those illustrated in FIG. 1, as well as other geometrical shapes not illustrated herein to simulate a wide variety of different furniture items and other home/business furnishings. FIG. 11 also illustrates other accessories which can be provided for use with the simulated toy furniture or other furnishings represented therein such as accessories 56 (floor rug), 58 (TV antenna), 60 (pillow), 62 (decorator pillow) and 64 (wall pennant).

Figure 12:
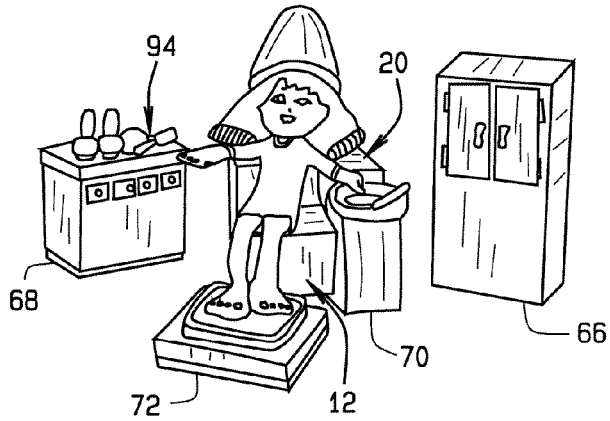
FIG. 12 is a perspective view illustrating another simulated room setting such as a beauty parlor wherein a plurality of the different furniture items illustrated therein are simulated through the use of a plurality of different types of the present slipcovers in combination with some of the present system components.

FIG. 12 represents another simulated room setting such as a beauty parlor wherein a plurality of the particular furniture items illustrated therein are simulated through the use of a plurality of different types of the present slipcovers in combination with some of the present system components. For example, the cabinet 66, work cabinet or station 68, manicure table 70 and pedicure stand 72 are all formed using slipcovers having the appropriate indicia illustrated thereon which are positioned over an appropriately shaped system component. The chair or seating structure illustrated in FIG. 12 upon which the toy doll is seated can be formed utilizing system components 12 and 20 positioned in abutting relationship as illustrated in FIG. 12. Again, FIG. 12 is merely illustrative of the different types of furniture items, appliances, and other types of home or business furnishings which can be represented and simulated by the present slipcovers in combination with the present system components.

Figure 13:
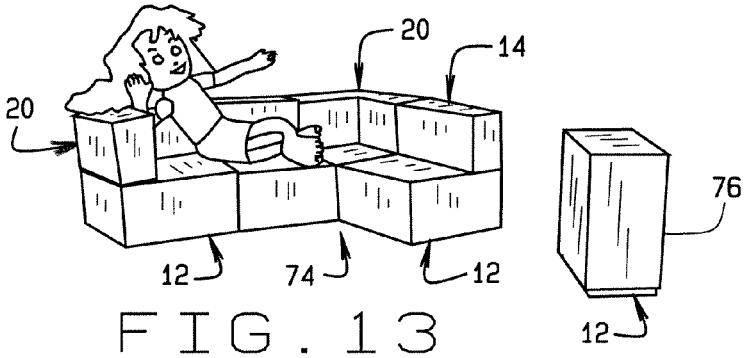
FIG. 13 is a perspective view illustrating still another typical room setting utilizing a combination of the present system components and the present slipcovers.

FIG. 13 illustrates another typical room setting utilizing a combination of the present system components such as the components 12, 14 and 20 to simulate a differently shaped couch or sectional unit 74 and a slipcover 76 positioned over a system component such as system component 12 for simulating another piece of furniture in the room setting. Again, the room setting of FIGS. 11, 12 and 13 are for illustrative purposes only and are disclosed to illustrate how a plurality of the individual system component members of the present invention in combination with a plurality of the present slipcovers can be positioned to simulate a wide variety of different furniture pieces and home/business furnishings associated with a particular room setting. When the particular furniture items illustrated in FIGS. 11, 12 and 13 are no longer needed, all such furniture items can be easily disassembled and some or all of the individual system components and/or slipcovers can be reused in an entirely different arrangement to simulate different furniture items, different home/business furnishings and different room settings.

Figure 14:
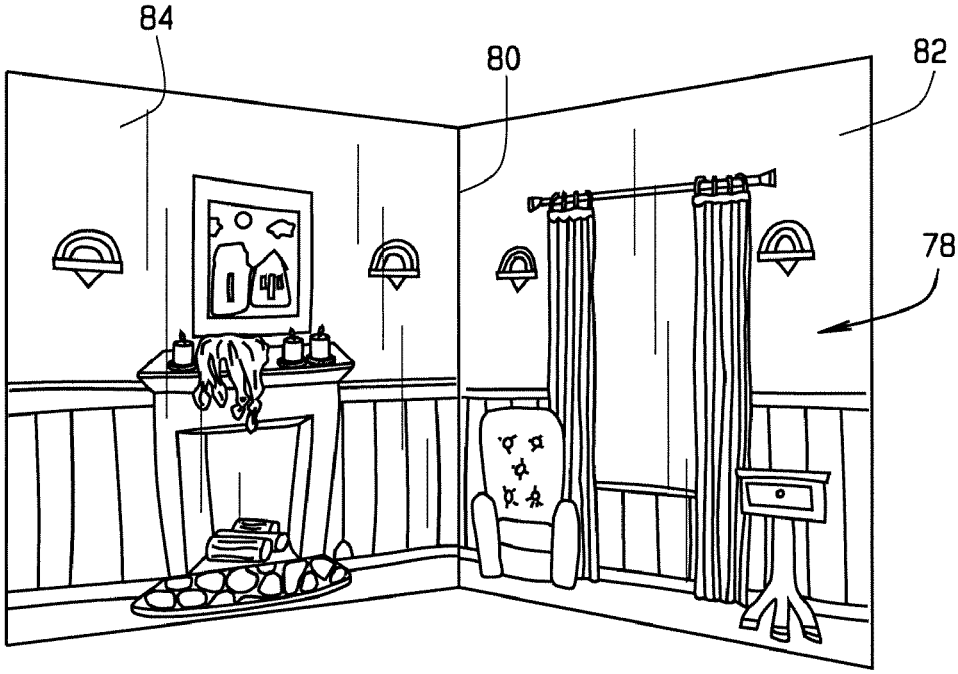
FIG. 14 illustrates one embodiment of the present wall boards which can be used in conjunction with the present system components illustrated in FIG. 1 and the present slipcovers illustrated in FIG. 7 to achieve a particular room setting.
Figure 15:
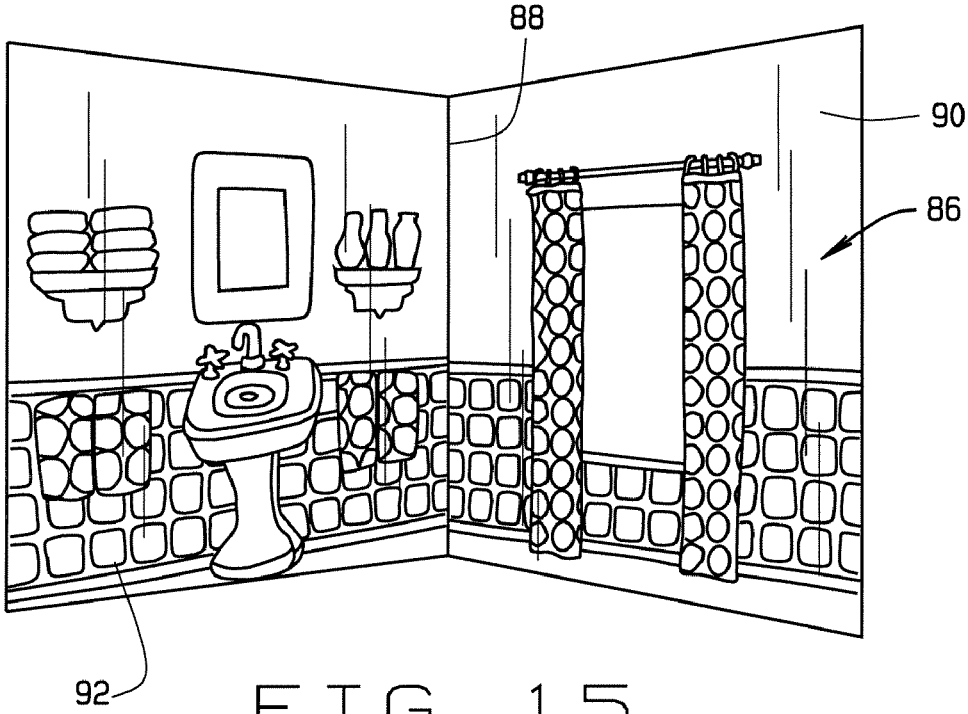
FIG. 15 illustrates another embodiment of the present wall boards to simulate a different room setting.

In another aspect of the present invention, one or more wall boards are provided to simulate at least some of the walls associated with a particular room setting. For example, FIGS. 14 and 15 illustrate a room setting simulated through the use of a single wall board or panel which is bendable to simulate at least two walls associated with a particular room setting. FIG. 14 discloses a wall board 78 having indicia associated therewith to simulate a living room or study type atmosphere, the wall board 78 being foldable or bendable about fold line 80 thereby dividing wall board 78 into two distinct wall portions 82 and 84. Wall portion 82 includes indicia thereon representative of a window, certain wall hangings, and appropriate furniture whereas wall portion 84 includes a fireplace and other wall hangings. Wall portions 82 and 84 can be angularly oriented relative to each other via fold line 80 so as to simulate two walls of a particular room. Although wall board 78 is illustrated as having only one fold line, namely, fold line 80, it is recognized and anticipated that wall board 78 could include any plurality of fold lines such as fold line 80 so as to simulate any number of walls associated with a particular room setting.

In a similar fashion, FIG. 15 illustrates a single wall board 86 which is foldable or bendable about fold line 88 to again produce two separate wall portions 90 and 92 which, in this particular illustration, represent two walls of a typical bathroom. More particularly, wall portion 90 includes tile and a shower curtain associated with a conventional shower or combination bath tub/shower, whereas wall portion 92 likewise includes tile, towel racks with towels, a sink, a mirror and appropriate wall hangings. Here again, wall portions 90 and 92 can be positioned at any angular orientation relative to each other to simulate two walls associated with a typical bathroom. Any room in any house or business can be simulated and portrayed via appropriate indicia associated with each wall board and/or each respective wall panel associated therewith. Although it is preferable that a single wall board having one or more locations therealong which are foldable or bendable to simulate a plurality of walls associated with a particular room setting be provided, it is also anticipated and recognized that individual wall panels illustrating a particular room setting can likewise be provided. In this situation, the individual wall panels can be either placed in adjacent abutting relationship to each other to simulate a particular room setting, or such individual wall panels can be removably attached or otherwise secured to each other to again simulate any number of walls associated with a particular room setting.

Figure 16:
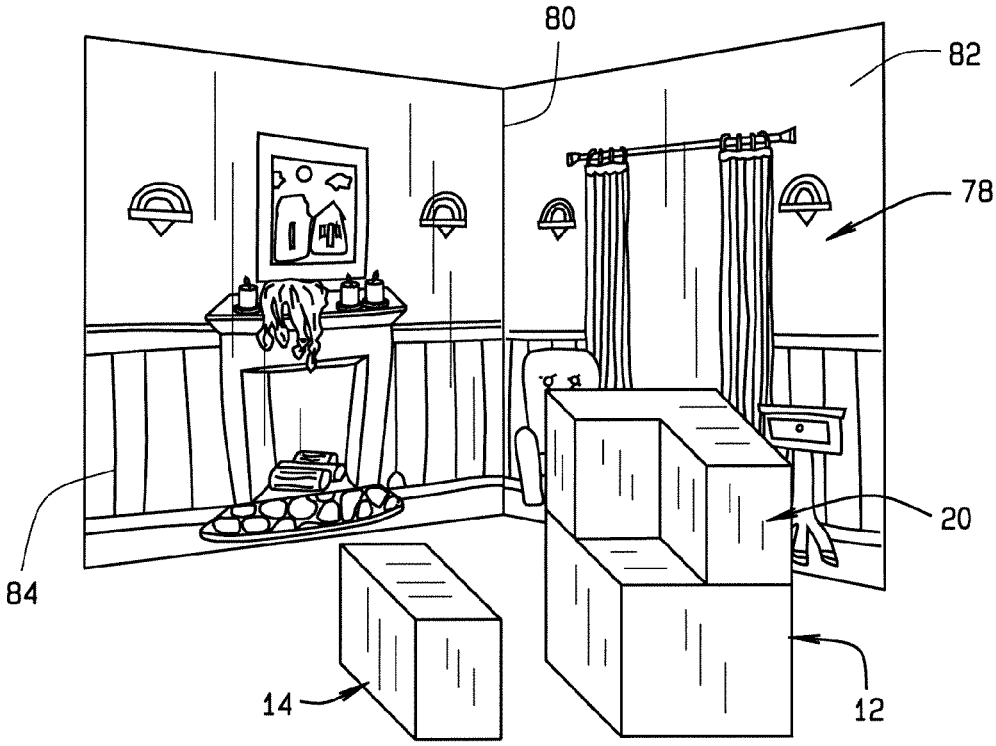
FIG. 16 is a perspective view illustrating the use of the present wall boards in combination with a plurality of the present system components to simulate a particular room setting.

The present wall boards in conjunction with the plurality of system components and the plurality of slipcovers can be mixed and matched as discussed above to simulate a particular room setting. For example, FIG. 16 illustrates the use of wall board 78 to simulate one embodiment of a living room setting. In the embodiment illustrated in FIG. 16, wall board 78 is used in conjunction with system components 12, 14 and 20 to simulate a small couch, a sectional piece, or a living room chair with an associated foot rest or ottoman.

Figure 17:
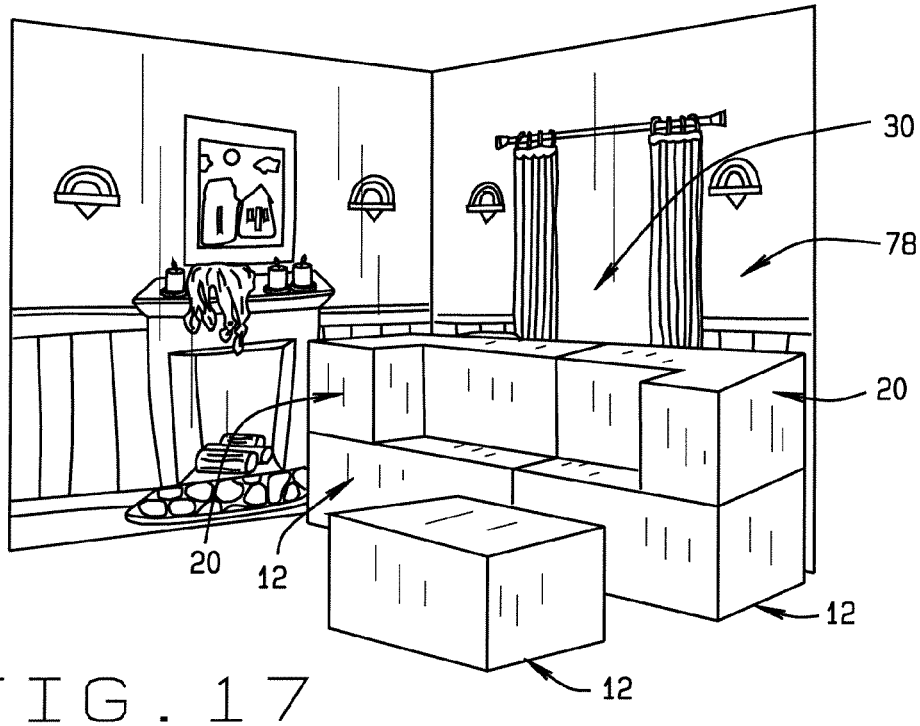
FIG. 17 is a perspective view illustrating the use of the same wall board as illustrated in FIG. 16 in combination with a plurality of different system components to achieve a different room setting.

In similar fashion, FIG. 17 illustrates use of the same wall board 78 with a plurality of different system components 12 and 20 to achieve another furniture arrangement within the same room setting. In the particular embodiment illustrated in FIG. 17, the present system components 12 and 20 are arranged to simulate a larger couch such as the couch member 30 illustrated in FIGS. 2, 4 and 6 along with a traditional coffee table or occasional table simulated through the use of a single system component 12. Still further, it is also recognized and anticipated that the particular room settings illustrated in FIGS. 4, 6, 11, 12 and 13 can likewise be utilized in conjunction with appropriate wall boards to further enhance those particular room settings. In addition, although the room settings illustrated in FIGS. 16 and 17 do not illustrate use of the present slipcovers to simulate a particular furniture item as illustrated in FIGS. 11, 12 and 13, any combination of the present slipcovers in conjunction with the present system components including geometrical shapes not illustrated herein can be utilized to simulate specific furniture items and other accessories associated with a particular room setting including the present wall boards.

It is also recognized that other accessories can be provided for attachment to the present wall boards, or placement within a particular simulated room setting to further stimulate and enhance the play of a child. For example, accessories 56, 58, 60 and 62 (FIG. 11) can be provided for placement in association with particular furniture items to enhance a particular room setting. Additional accessories such as the hair dryer and other accessories 94 illustrated in the FIG. 12 for use in a hair parlor setting can likewise be provided for use with specific furniture pieces. Still further, various types of wall hangings such as the banner 64 illustrated in FIG. 11, or specific paintings, mirrors, and other wall type accessories such as those illustrated in association with wall boards 78 (FIG. 14) and 86 (FIG. 15) can be provided in individual form for attachment in a conventional manner, such as through the use of VELCRO® type fastener means or magnetic means, to the present wall boards.

Figure 18:
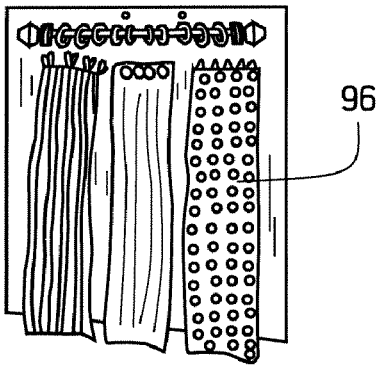
FIGS. 18 and 19 illustrate some of the accessories such as drapes, blinds, curtains, and/or shower curtains which can be interchangeably used with the present wall boards to change the overall look and appearance of a particular room setting.
Figure 19:
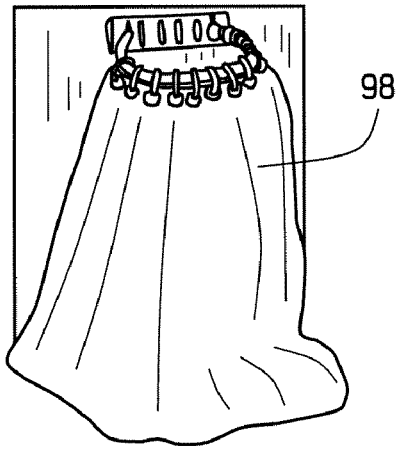

Still further, accessories in the form of drapes, blinds, and/or curtains such as the curtains 96 illustrated in FIG. 18, or shower curtains such as the shower curtain 98 illustrated in FIG. 19 can likewise be provided for attachment to the present wall boards such as wall boards 78 and 86 illustrated in FIGS. 15–17. More particularly, wall board 78 and, in particular, wall panel 82 can be provided with a simulated curtain rod such that a wide variety of different styles and patterns of drapes and/or curtains can be interchangeably used with wall board 78 to change the overall look and appearance of that particular room setting. In similar fashion, a wide variety of different types of shower curtains such as shower curtain 98 can be removably interchanged with wall panel 90 to again change the overall look and appearance of the bathroom setting illustrated in FIG. 15. It is also anticipated and recognized that attachment of the drapes, curtains, and/or shower curtains to a particular wall board can be accomplished in a wide variety of different manners including directly attaching such accessories via VELCRO® type fastening means, magnetic means and suction cup means directly to the wall board. Other attachment mechanisms are likewise envisioned and anticipated.

Figure 20:
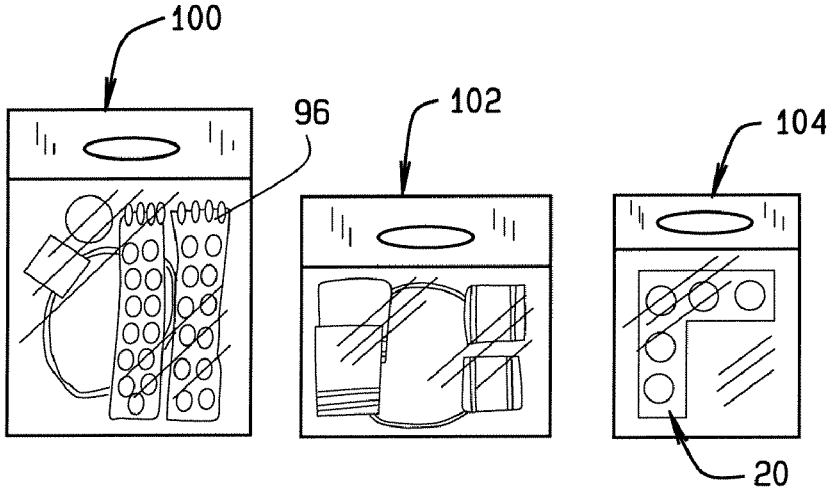
FIG. 20 illustrates various kit arrangements for packaging and merchandising various components of the present system.

All of the various components of the present system such as the plurality of system components 12, 14, 16, 18 and 20, the plurality of present slipcovers such as the slipcovers 40, 42, 44, 48, 50, 52, 54, 66, 68, 70, 72 and 76, any plurality of the present wall boards such as the wall boards 78 and 86, as well as any number of individual accessories and other room/business accent pieces such as accessories 56, 58, 60, 62, 64, 94, 96 and 98 can be packaged and provided in any combination including in kit form based upon furniture and furnishings associated with a particular room, based upon a particular category of furniture items, based upon any combination of furniture items and room furnishings, based upon individual items, or the entire system can be provided in a single package. For example, as illustrated in FIG. 20, accessories associated with a bedroom setting including curtains or drapes 96 can be packaged in kit form in kit package 100; accessories associated with a bathroom setting can be packaged in kit form such as kit package 102; and individual predetermined structural pieces or system components such as the system component 20 can be packaged in an individual format such as in package 104. It is further recognized and anticipated that any number of geometrically shaped system components can be packaged together; any number of slipcovers with various indicia imprinted thereon can be packaged together; any number of wall boards can be packaged together; any number of accessories can be packaged together; and any combination of any of the present system components, slipcovers, wall boards and/or accessories can be packaged together.

For these and other reasons, the present invention therefore provides a transformable toy furniture and room system which utilizes a plurality of predetermined geometrically shaped system components, a plurality of slipcovers, a plurality of wall boards, and a plurality of other accessories all of which can be used in a wide variety of different combinations as explained above to simulate a wide variety of different furniture items, different home/business furnishings, and different room settings. While the present invention has been disclosed herein and described by means of specific embodiments and specific applications, it is recognized and anticipated that many changes, modifications, variations and other uses and applications of the present invention will, however, become apparent to those skilled in the art after considering this specification and the accompanying drawings. All such changes, modifications, variations and other uses and applications which do not depart from the spirit and scope of the present invention are deemed to be covered by the invention which is limited only by the claims which follow.

The invention claimed is:

1. A system for simulating a variety of different toy furniture items comprising:

a plurality of three-dimensional predetermined geometrically shaped members;

at least some of said plurality of predetermined geometrically shaped members being adapted for use individually to simulate particular furniture items;

at least some of said predetermined geometrically shaped members being adapted to be positioned and repositioned both in a side-by-side adjacent relationship to other shaped members and in a stacked adjacent relationship to other shaped members in a plurality of different configurations to simulate a plurality of different furniture items, none of said shaped members being physically attached to each other to simulate said plurality of different furniture items; and each of said plurality of shaped members including a plurality of exterior surfaces, at least some of the exterior surfaces of at least some of said plurality of shaped members including indicia thereon.

2. The system defined in claim 1 wherein said plurality of shaped members includes a plurality of groups of shaped members, each group having at least two similarly shaped members, the shaped members of each group being different from each other.

3. The system as defined in claim 1 wherein said plurality of shaped members includes at least one substantially square shaped member, at least one substantially rectangularly shaped member, at least one substantially triangularly shaped member, at least one substantially circularly shaped member, and at least one substantially L-shaped member.

4. The system as defined in claim 3 wherein said plurality of shaped members includes at least a pair of substantially square shaped members, at least a pair of substantially rectangularly shaped members, at least a pair of substantially triangularly shaped members, at least a pair of substantially circularly shaped members, and at least a pair of substantially L-shaped members.

5. The system as defined in claim 1 wherein at least some of the exterior surfaces of at least some of said plurality of shaped members include substantially the same indicia thereon.

6. The system as defined in claim 5 wherein the indicia is associated with the exterior surfaces of at least some of said plurality of shaped members such that when some of said shaped members are arranged in adjacent relationship to simulate a particular furniture item, at least some of the exterior surfaces of each such shaped members simulating the particular furniture item will present substantially the same indicia for viewing.

7. The system as defined in claim 1 wherein at least some of said plurality of shaped members can be arranged to simulate a room setting with multiple toy furniture items.

8. The system as defined in claim 1 further including at least one slipcover shaped and dimensioned to insertably receive at least one of said plurality of shaped members, said at least one slipcover having indicia associated therewith representative of a particular furniture item or other home/business furnishing, said slipcover when positioned over one of said shaped members thereafter simulating the furniture item or other home/business furnishing depicted on said slipcover.

9. The system defined in claim 8 wherein said at least one slipcover is packaged in kit form.

10. The system defined in claim 8 wherein at least some of said plurality of shaped members and said at least one slipcover are packaged in kit form.

11. The system as defined in claim 1 further including at least one slipcover shaped and dimensioned to be positioned over two or more shaped members when said shaped members are positioned in an adjacent configuration.

12. The system defined in claim 1 further including a plurality of slipcovers shaped and dimensioned to insertably receive at least one of said plurality of shaped members, each of said plurality of slipcovers having indicia associated therewith representative of a particular furniture item or other home/business furnishing, each slipcover when positioned over one of said shaped members thereafter simulating the furniture item or other home/business furnishing depicted on said slipcover.

13. The system defined in claim 12 wherein at least some of said plurality of slipcovers are packaged in kit form.

14. The system defined in claim 1 wherein at least some of said plurality of shaped members are packaged in kit form.

15. The system defined in claim 1 including at least one wall board having indicia associated therewith for simulating a particular room setting.

16. The system defined in claim 15 wherein said at least one wall board includes at least one fold line, said wall board being bendable about said at least one fold line.

17. The system defined in claim 15 wherein said at least one wall board is packaged in kit form.

18. The system defined in claim 15 wherein at least some of said plurality of shaped members and said at least one wall board are packaged in kit form.

19. The system defined in claim 15 including at least one accessory attachable to said wall board.

20. A system for simulating a variety of different toy furniture items comprising:

a plurality of three-dimensional predetermined shaped members;

at least some of said shaped members being adapted for use individually to simulate a particular furniture item;

at least some of said shaped members being adapted to be positioned and repositioned adjacent to other shaped members in a plurality of different configurations to simulate a plurality of different furniture items; and at least one slipcover shaped and dimensioned to be positioned over at least one of said plurality of shaped members, said at least one slipcover having indicia associated therewith representative of a particular furniture item or other home/business furnishing, said at least one slipcover when positioned over at least one of said shaped members thereafter simulating the particular furniture item or other home/business furnishing depicted on said at least one slipcover.

21. The system defined in claim 20 wherein said plurality of shaped members includes at least one substantially square shaped member, at least one substantially rectangularly shaped member, at least one substantially triangularly shaped member, at least one substantially circularly shaped member, and at least one substantially L-shaped member.

22. The system defined in claim 20 wherein each of said plurality of shaped members includes a plurality of exterior surfaces, at least some of the exterior surfaces of at least some of said plurality of shaped members including indicia thereon.

23. The system defined in claim 20 including a plurality of slipcovers shaped and dimensioned to be positioned over at least one of said plurality of shaped members, each of said slipcovers having indicia associated respectively therewith representative of a particular furniture itent or other home/business furnishing.

24. The system defined in claim 23 wherein at least one of said plurality of slipcovers is shaped and dimensioned to be positioned over two or more shaped members when said shaped members are positioned in an adjacent configuration.

25. The system defined in claim 20 including at least one wall board having indicia associated therewith to simulate a particular room setting.

26. The system defined in claim 25 wherein said at least one wall board includes at least one fold line, said wall board being bendable about said at least one fold line.

27. The system defined in claim 25 including at least one accessory attachable to said at least one wall board.

28. The system defined in claim 20 including a plurality of wall boards, each wall board having indicia associated respectively therewith to simulate a particular room setting.

29. A system for simulating a variety of different toy furniture items comprising:

a plurality of predetermined geometrically shaped members;

at least some of said shaped members being adapted to be positioned and repositioned adjacent to other shaped members in a plurality of different configurations to simulate a plurality of different furniture items; and a plurality of slipcovers shaped and dimensioned to be positioned over at least one of said plurality of shaped members, each of said slipcovers having indicia associated respectively therewith representative of a particular furniture item or other home/business furnishing, each slipcover when positioned over at least one of said shaped members thereafter simulating the particular furniture item or other home/business furnishing depicted on said slipcover.

30. A system for simulating a variety of different toy furniture items in a particular room setting comprising:

a plurality of three-dimensional predetermined shaped members;

at least some of said shaped members being adapted to be positioned and repositioned adjacent to other shaped members in a plurality of different configurations to simulate a plurality of different furniture items;

at least one slipcover shaped and dimensioned to be positioned over at least one of said plurality of shaped members, said at least one slipcover having indicia associated therewith representative of a particular furniture item or other home/business furnishing, said at least one slipcover when positioned over at least one of said shaped members thereafter simulating the particular furniture item or other home/business furnishing depicted on said at least one slipcover; and at least one wall board having indicia associated therewith representative of a particular room setting.

31. The system defined in claim 30 wherein said at least one slipcover is shaped and dimensioned to be positioned over two or more shaped members when said shaped members are positioned in an adjacent configuration.

32. The system defined in claim 30 wherein said at least one wall board includes at least one fold line, said wall board being bendable about said at least one fold line.

33. The system defined in claim 30 including a plurality of wall boards.

34. The system defined in claim 30 including at least one accessory attachable to said at least one wall board.

35. A method for simulating a variety of different toy furniture items in a particular room setting comprising:

(a) providing a plurality of three-dimensional predetermined shaped members wherein at least some of said predetermined shaped members are adaptable to be positioned and repositioned both in a side-by-side adjacent relationship to other shaped members and in a stacked adjacent relationship to other shaped members in a plurality of different configurations to simulate a plurality of different furniture items;

(b) positioning at least some of said predetermined shaped members in an adjacent non-attached configuration to simulate a particular furniture item; and (c) providing at least one wall board having indicia associated therewith for simulating a particular room setting.

36. The method defined in claim 35 further comprising:

providing indicia on at least some of the exterior surfaces of at least some of said plurality of shaped members.

37. The method defined in claim 35 further comprising:

providing at least one slipcover shaped and dimensioned to insertably receive at least one of said plurality of shaped members, said at least one slipcover having indicia associated therewith representative of a particular furniture item or other home/business furnishing; and positioning said at least one slipcover over at least one of said shaped members.

38. The method defined in claim 35 further comprising:

providing at least one accessory attachable to said wall board.

39. A method for simulating a variety of different toy furniture items comprising:

providing a plurality of three-dimensional predetermined shaped members, at least some of said shaped members being adaptable to be positioned and repositioned adjacent to other shaped members in a plurality of different configurations to simulate a plurality of different furniture items;

positioning at least some of said shaped members in various adjacent configurations to simulate a plurality of different furniture items;

providing at least one slipcover shaped and dimensioned to be positioned over at least one of said plurality of shaped members, said at least one slipcover having indicia associated therewith representative of a particular furniture item or other home/business furnishing; and positioning said at least one slipcover over at least one of said shaped members so as to simulate the particular furniture item or other home/business furnishing depicted on said slipcover.

40. The method defined in claim 39 further comprising:

providing at least one wall board having indicia associated therewith to simulate a particular room setting.

41. The method defined in claim 40 further comprising:

providing at least one accessory attachable to said at least one wall board.

42. A method for simulating a variety of different toy furniture items comprising:

providing a plurality of predetermined shaped members;

providing a plurality of slipcovers shaped and dimensioned to be respectively positioned over at least some of said plurality of shaped members, each of said slipcovers having indicia associated respectively therewith representative of a particular furniture item or other home/business furnishing; and positioning each of said slipcovers over at least some of said shaped members to simulate the particular furniture item or other home/business furnishing depicted on said slipcovers.

43. A kit for simulating a variety of different toy furniture items in a particular room setting comprising the components of:

a plurality of predetermined shaped members;

at least some of said plurality of shaped members being adapted for use individually to simulate particular furniture items;

at least some of said shaped members being adapted to being positioned and repositioned both in a side-by-side adjacent relationship to other shaped members and in a stacked adjacent relationship to other shaped members in a plurality of different configurations to simulate a plurality of different furniture items, none of said shaped members being physically attached to each other to simulate said plurality of different furniture items; and at least one wall board having indicia associated therewith to simulate a particular room setting;

said kit components being packaged and provided to a user for accomplishing the simulation of a wide variety of different toy furniture items.

44. The kit defined in claim 43 including at least one slipcover shaped and dimensioned to be positioned over at least one of said plurality of shaped members, said at least one slipcover having indicia associated therewith representative of a particular furniture item or other home/business furnishing, said at least one slipcover when positioned over at least one of said shaped members thereafter simulating the particular furniture item or other home/business furnishing depicted on said at least one slipcover.

45. A kit for simulating a variety of different toy furniture items comprising the components of:

a plurality of predetermined shaped members, at least some of said shaped members being adapted to be positioned and repositioned adjacent to other shaped members in a plurality of different configurations to simulate a plurality of different furniture items;

at least one slipcover shaped and dimensioned to be positioned over at least one of said plurality of shaped members, said at least one slipcover having indicia associated therewiith representative of a particular furniture item or other home/business furnishing, said at least one slipcover when positioned over at least one of said shaped members thereafter simulating the particular furniture item or other home/business furnishing depicted on said at least one slipcover; and said kit components being packaged and provided to a user for accomplishing the simulation of a wide variety of different toy furniture items.

46. The kit defined in claim 45 including a plurality of slipcovers shaped and dimensioned to be positioned over at least one of said plurality of shaped members, each of said plurality of slipcovers having indicia associated respectively therewith representative of a particular furniture item or other home/business furnishing.

47. The kit defined in claim 45 including at least one wall board having indicia associated therewith to simulate a particular room setting.

48. The kit defined in claim 47 including at least one accessory attachable to said at least one wall board.

49. A kit for simulating a variety of different toy furniture items in a particular room setting comprising the components of:

a plurality of three-dimensional predetermined shaped members, at least some of said shaped members being adapted to be positioned and repositioned adjacent to other shaped members in a plurality of different configurations to simulate a plurality of different furniture items;

at least one slipcover shaped and dimensioned to be positioned over at least one of said plurality of shaped members, said at least one slipcover having indicia associated therewith representative of a particular furniture item or other home/business furnishing, said at least one slipcover when positioned over at least one of said shaped members thereafter simulating the particular furniture item or other home/business furnishing depicted on said at least one slipcover;

at least one wall board having indicia associated therewith representative of a particular room setting; and said kit components being packaged and provided to a user for accomplishing the simulation of a variety of different toy furniture items in a particular room setting.

50. The kit defined in claim 49 including a plurality of slipcovers shaped and dimensioned to be positioned over at least one of said plurality of shaped members, each of said plurality of slipcovers having indicia associated respectively therewith representative of a particular furniture item or other home/business furnishing.

51. The kit defined in claim 49 including a plurality of wall boards.

52. The kit defined in claim 49 including at least one accessory attachable to said at least one wall board.

53. A system for simulating a variety of different toy furniture items comprising:

a plurality of three-dimensional predetermined geometrically shaped members;

at least some of said plurality of predetennined geometrically shaped members being adapted for use individually to simulate particular furniture items;

at least some of said predetermined geometrically shaped members being adapted to be positioned and repositioned both in a side-by-side adjacent relationship to other shaped members and in a stacked adjacent relationship to other shaped members in a plurality of different configurations to simulate a plurality of different furniture items, none of said shaped members being physically attached to each other to simulate said plurality of different furniture items; and at least some of said plurality of shaped members being packaged in kit form.

* * * * *

UNITED STATES PATENT AND TRADEMARK OFFICE

CERTIFICATE OF CORRECTION

PATENT NO. : 7,086,923 B2
APPLICATION NO. : 10/708630
DATED : August 8, 2006
INVENTOR(S) : Martin W. Karabees It is certified that error appears in the above-identified patent and that said Letters Patent is hereby corrected as shown below:

Title Page

Item (56) References Cited, insert

| | | | |
|---|---|---|---|
| -- | 20020153813 | 10/24/2002 | Hadinata |
| | 5,575,223 | 11/19/1996 | Inntegra AG |
| | 5,169,352 | 12/08/1992 | Petersen |
| | 5,754,995 | 05/26/1998 | Behrendt |
| | 20030221593 | 12/04/2003 | Usagani |
| | 20010034183 | 10/25/2001 | Brownrigg |
| | 4,235,039 | 11/25/1980 | Brooks |
| | 4,723,820 | 02/09/1988 | Kroneck |
| | 20020195907 | 12/26/2002 | Lawson |
| | 4,934,756 | 06/19/1990 | Webb |
| | 5,026,121 | 06/25/1991 | Ratalahti |
| | 4,205,876 | 06/03/1980 | Cetina |
| | 5,549,408 | 08/27/1996 | Lo |

Photocopy of Angelina Ballerina™ fold-up room product, including dolls and furniture; American Girl online catalogue, June 16, 2004, 5 pages. --

Claim 1, Col. 13, line 6, after "thereon" insert -- , wherein the indicia is representative of one or more upholstery patterns. --

Claim 23, Col. 14, line 54, delete "itent" and replace with -- item --

Claim 53, Col. 18, line 38, delete "predetennined" and replace with -- predetermined --

Signed and Sealed this

Twenty-first Day of August, 2007

JON W. DUDAS
*Director of the United States Patent and Trademark Office*